US011913312B2

(12) United States Patent
Liang et al.

(10) Patent No.: US 11,913,312 B2
(45) Date of Patent: Feb. 27, 2024

(54) INTELLIGENT OIL EXTRACTION SYSTEM USING ALL-METAL SCREW PUMP

(71) Applicant: WUXI HENGXIN BEISHI TECHNOLOGY CO., LTD, Jiangsu (CN)

(72) Inventors: Haiyang Liang, Jiangsu (CN); Guang Zhou, Jiangsu (CN); Xuelei Sun, Jiangsu (CN); Xueling Sun, Jiangsu (CN); Zhihai Zhang, Jiangsu (CN)

(73) Assignee: WUXI HENGXIN BEISHI TECHNOLOGY CO., LTD, Wuxi (CN)

( * ) Notice: Subject to any disclaimer, the term of this patent is extended or adjusted under 35 U.S.C. 154(b) by 384 days.

(21) Appl. No.: 17/312,948

(22) PCT Filed: Oct. 29, 2019

(86) PCT No.: PCT/CN2019/113970
§ 371 (c)(1),
(2) Date: Jun. 11, 2021

(87) PCT Pub. No.: WO2020/177349
PCT Pub. Date: Sep. 10, 2020

(65) Prior Publication Data

US 2022/0056791 A1 Feb. 24, 2022

(30) Foreign Application Priority Data

Mar. 6, 2019 (CN) ..... 201910167981.1

(51) Int. Cl.
*E21B 43/12* (2006.01)
*E21B 47/008* (2012.01)
(Continued)

(52) U.S. Cl.
CPC ..... *E21B 43/126* (2013.01); *E21B 47/008* (2020.05); *F04B 15/02* (2013.01);
(Continued)

(58) Field of Classification Search
CPC .. E21B 43/126; E21B 43/127; E21B 17/1071; E21B 47/009
See application file for complete search history.

(56) References Cited

U.S. PATENT DOCUMENTS 2,603,098 A * 7/1952 Cremeens ..... E21B 43/126 74/544
3,404,877 A * 10/1968 Darnell ..... F04B 53/145 267/128

(Continued)

FOREIGN PATENT DOCUMENTS

CN 201262146 Y 6/2009

*Primary Examiner* — David Carroll
(74) *Attorney, Agent, or Firm* — Zhigang Ma

(57) ABSTRACT

An intelligent oil extraction system using an all-metal screw pump includes: the all-metal screw pump, an oil collecting unit (43), and a steam generating unit (45); wherein an internal threaded curve surface and an external threaded curve surface of the all-metal screw pump are both tapered spiral structures with equal tapers; the oil extraction system comprises a lifting mechanism and monitoring and control mechanism; the monitoring and control mechanism comprises: a controller (34), a torque sensor (35), a flow sensor (36), a pressure sensor (39), a liquid level detector (38), and a backup power source (37); the controller (34) is electrically connected to the torque sensor (35), the flow sensor (36), the pressure sensor (39), the liquid level detector (38), the backup power source (37), a drive motor (48), a servo motor (33), a first valve and a second valve.

8 Claims, 6 Drawing Sheets

(51) Int. Cl.

| | |
|---|---|
| ***F04B 15/02*** | (2006.01) |
| ***F04C 2/107*** | (2006.01) |
| ***F04C 14/08*** | (2006.01) |
| ***F04C 14/28*** | (2006.01) |

(52) U.S. Cl.
CPC ..... *F04C 2/107* (2013.01); *F04C 14/08* (2013.01); *F04C 14/28* (2013.01)

(56) References Cited

U.S. PATENT DOCUMENTS

| | | | | |
|---|---|---|---|---|
| 6,293,347 | B1 * | 9/2001 | Cahill | E21B 33/08 166/241.1 |
| 6,457,958 | B1 * | 10/2002 | Dunn | E21B 4/02 418/48 |
| 10,107,371 | B2 * | 10/2018 | Rappenecker | F16H 19/08 |
| 2015/0075296 | A1 * | 3/2015 | Hart | G01L 1/2206 73/862.623 |
| 2022/0090599 | A1 * | 3/2022 | Liang | F04C 15/0057 |

* cited by examiner

INTELLIGENT OIL EXTRACTION SYSTEM USING ALL-METAL SCREW PUMP

BACKGROUND OF THE PRESENT INVENTION

Field of Invention

The present invention relates to a technical field of oil extraction equipment, and more particularly to an intelligent oil extraction system using an all-metal screw pump.

Description of Related Arts

Conventional oil extraction equipment is mainly pumpjacks and screw pumps. The screw pumps are divided into all-metal screw pumps and rubber screw pumps. Compared to the pumpjacks, the screw pumps have the following advantages: 1. small space occupation, wherein ground drive unit along can save ⅔ of the installation space; 2. low kinetic energy loss, wherein some of the kinetic energy of the pumpjack is useless and does not output oil, while the all-metal screw pump continuously outputs oil during the working process; 3. convenient control, wherein the oil output can be controlled by adjusting motor speed; 4. sufficient applicability, wherein the screw pump has a good effect on heavy oil, and is suitable for various viscosities; 5. uniform flow, low vibration frequency and low noise; 6. simple structure and low failure rate, wherein no air lock will be formed; and 7. simple installation and replacement.

Compared with the rubber screw pump, the all-metal screw pump has the following advantages: steam can be injected through the pump, which means the steam is directly injected into the well through the all-metal screw pump, wherein there is no need to lift the stator of the screw pump, and the work efficiency is high.

SUMMARY OF THE PRESENT INVENTION

Technical Problem

The conventional metal screw pumps have the following defects: 1. radial dimensions of stator and rotor are uniform along a longitudinal direction, wherein during operation, sand mixed in crude oil will wear the stator and the rotor, which will increase a gap between the stator and rotor, resulting in a decrease in pumping pressure of the metal screw pump; that is to say, pump efficiency will be gradually reduced during use, and after the pumping pressure is reduced to a certain level, the crude oil cannot be pumped out, and the screw pump needs to be replaced; not only the service life of the screw pump is short, but it also takes a long time to replace the screw pump, which reduces the efficiency of crude oil extraction; 2. intelligence degree is low, wherein radial dimensions of the stator and rotor are uniform along the longitudinal direction; as a result, a, after wearing, the gap between the stator and the rotor cannot be adjusted, which means the pump efficiency cannot be adjusted; b, after sand content of the crude oil changes, the gap between the stator and the rotor cannot be adjusted, thereby further wearing the stator and rotor, and reducing the service life of the screw pump; and c, after power cut off, the sand between sleeve and sucker rod will fall together with the crude oil and be deposited in the gap between the stator and the rotor, jamming the rotor, which means a phenomenon of sand jam occurs; after the power is turned on, the rotor must be lift up to completely separate from the sand jam section, which consumes a lot of manpower and material resources; furthermore, during such process, the entire screw pump may be damaged.

Technical Solution

An object of the present invention is to provide an intelligent oil extraction system using an all-metal screw pump, which can solve the technical problems such as short service life, high energy consumption, low pump efficiency, sand jam, and low intelligence of the conventional metal screw pumps.

Accordingly, the present invention provides an intelligent oil extraction system using an all-metal screw pump, comprising: the all-metal screw pump, an oil collecting unit, and a steam generating unit; wherein the all-metal screw pump comprises: a stator, a rotor, a sucker rod, a sleeve, a reducer, and a drive motor; the stator has an internal threaded curve surface; the rotor is installed in the stator and has an external threaded curve surface matched with the internal threaded curve surface of the stator; the sleeve is connected to the stator, and the sucker rod is installed in the sleeve and connected to the rotor; the drive motor, the reducer and the sucker rod are connected in sequence; the oil collecting unit stores crude oil, and the steam generating unit provides steam; an oil outlet of the all-metal screw pump is connected to an input end of an oil pipeline, and an output end of the oil pipeline is connected to an oil inlet of the oil collecting unit and a steam outlet of the steam generating unit; a first valve is install at the oil inlet of the oil collecting unit, and a second valve is installed at the steam outlet of the steam generating unit; the internal threaded curve surface and the external threaded curve surface are both tapered spiral structures with equal tapers; the oil extraction system further comprises a lifting mechanism, and the lifting mechanism comprises: a cross beam, a first clamping member, a second clamping member, a plane bearing, two lifting assemblies, and a servo motor; the sucker rod penetrates the plane bearing and the cross beam; the first clamping member is detachably fixed to the sucker rod which is below the cross beam; the first clamping member and the reducer are in a sliding fit along an up-down direction, thereby transmitting torque to the reducer and the sucker rod; the second clamping member is detachably fixed to the sucker rod which is above the cross beam; the second clamping member abuts against the plane bearing, and the plane bearing is installed on the cross beam; the two lifting assemblies are separately provided at both ends of the cross beam, and output ends of the two lifting assemblies are fixed to the cross beam; the servo motor drives the lifting assemblies to perform lifting motion; the oil extraction system further comprises a monitoring and control mechanism, and the monitoring and control mechanism comprises: a controller, a torque sensor, a flow sensor, a pressure sensor, a liquid level detector, and a backup power source; the controller is electrically connected to the torque sensor, the flow sensor, the pressure sensor, the liquid level detector, the backup power source, the drive motor, the servo motor, the first valve and the second valve; the torque sensor monitors pumping torque of the sucker rod; the flow sensor monitors a crude oil flow rate in the all-metal screw pump; the pressure sensor monitors a gas pressure in the screw pump; the liquid level detector monitors a liquid level in a well; the backup power source supplies power to the controller and the servo motor during power failure.

Preferably, the monitoring and control mechanism further comprises an oil-water analyzer; the oil-water analyzer is electrically connected to the controller, and analyzes an oil-water ratio of the well.

Preferably, the monitoring and control mechanism further comprises a video detector; the video detector is electrically connected to the controller, and records the surrounding environment of an installation position of the all-metal screw pump.

Preferably, the monitoring and control mechanism further comprises a memory; the memory is electrically connected to the controller.

Preferably, the torque sensor is replaced by a current sensor, or an additional current sensor is used.

Preferably, the first clamping member comprises two first clamping blocks; each of the first clamping blocks has an arc-shaped groove matched with the sucker rod; the two first clamping blocks are symmetrically assembled and locked by bolts and nuts; bottom ends of the first clamping blocks extend downwards to form a torque transmitting part; the torque transmitting part is connected to an output end of the reducer by a key joint, so as to be slidably fitted in the up-down direction; the second clamping member comprises second clamping blocks, a locking sleeve and a locking block; a quantity of the second clamping blocks is no less than two; the locking sleeve comprises a base and a casing connected to a top part of the base; a taper hole is drilled at a center of the base, which tapers from top to bottom; the base abuts against the plane bearing; the locking block comprises a presser and a connecting block connected to a top part of the presser; an external contour of the second clamping blocks is matched with the taper hole; the second clamping blocks wraps a radial circumference of the sucker rod and are installed in the taper hole; the connecting block is threadedly connected to the casing; the presser abuts downwards against the second clamping blocks. Each of the lifting assemblies comprises a worm gear box and a screw rod; a support frame is installed on a top part of the reducer; the worm gear box and the servo motor are installed on the support frame; the screw rod vertically penetrates the worm gear box and meshes with a worm gear of the worm gear box; a top end of the screw rod is connected to the cross beam; worm gear shafts of the worm gear boxes of the lifting assemblies are synchronized by a connecting shaft; the servo motor is connected to one of the worm gear shafts.

The intelligent oil extraction system further comprises an elastic telescopic component, wherein the elastic telescopic component comprises a movable part, a fixed part, and an elastic part; the movable part is fixed to the rotor, and the fixed part is fixed to the sucker rod; the movable part and the fixed part are slidingly fitted in the up-down direction and transmit torque to the sucker rod and the rotor; one end of the elastic member abuts against the movable part or the rotor, and the other end abuts against the fixed part or the sucker rod, so as to elastically contract and expand along a sliding direction of the movable part. Preferably, the movable part is a connecting shaft, the fixed part is a connecting seat, and the elastic part is a spring; the elastic telescopic component further comprises a limit component; the connecting shaft is inserted into a cavity of the connecting seat, and moves along an axial direction of the connecting seat to transmit torque by cooperating with the connecting seat; the spring is sleeved outside the connecting shaft and/or the connecting seat; one end of the spring abuts against the connecting seat or the sucker rod, and the other end abuts against the connecting shaft or the rotor; the limit component prevents the connecting shaft from separating from the connecting seat; an end of the rotor is adjacent to the connecting shaft, to which a first threaded joint is connected; an end of the connecting shaft is adjacent to the rotor, to which a second threaded joint is connected; the first threaded joint and the second threaded joint are connected by a threaded sleeve; the connecting seat is integrally formed or fixedly installed on the sucker rod; the limit component comprises a first convex flange and a limiting plate; the first convex flange is connected to an end of the connecting shaft adjacent to the connecting seat, and protrudes outwards in a diameter direction; the limiting plate is connected to an end of the connecting seat adjacent to the connecting shaft, and protrudes inwards in a diameter direction; external teeth are provided at an end of the connecting shaft adjacent to the first convex flange, and internal teeth are provided on the limiting plate; the external teeth mesh with the internal teeth; steps, which matches with the limiting plate, are provided on the connecting shaft.

Beneficial Effect

The beneficial effects of the present invention are as follows. 1. The wear of the stator and the rotor is uniform wear of the internal threaded curve surface and the external threaded curve surface, which means wear degree is the same everywhere. Since the internal threaded curve surface and the external threaded curve surface are both tapered spiral structures and have the same tapers, after being worn, the lifting mechanism drives the rotor to move down, in such a manner that the external threaded curve surface, which has a larger radial size and is located on an upper side of the rotor, can move down to cooperate with the internal threaded curve surface on a lower side of the stator that has a larger radial size after being worn. As a result, the gap between the adjusted internal threaded curve surface and the external threaded curve surface still maintains the size before wear, thereby ensuring pumping pressure of the all-metal screw pump, the output of the crude oil, and a high liquid output amount. Furthermore, the service life of the all-metal screw pump is effectively prolonged, and the replacement frequency of the all-metal screw pump is relatively reduced, which means the man-hour consumption caused by the replacement operation is reduced, and the crude oil extraction efficiency is increased. 2. The intelligence degree is improved as follows. a. After wear, the torque sensor monitors a torque decrease and the flow sensor monitors a crude oil output decreases, the controller controls the servo motor to move the rotor down, so as to reduce the gap between the stator and the rotor until the fluid output and torque are in the preset zone again, thereby maintaining the pump efficiency. b. After sand content is the crude oil changes, the torque sensor monitors the torque increase, and the controller controls the servo motor to move the rotor up, thereby increasing the gap between the stator and the rotor, and reducing the wear of the rotor and the stator. After the torque is reduced, the controller controls the servo motor to move the rotor down to restore the gap between the stator and the rotor, thereby prolonging the service life of the screw pump. c. After a power failure, the backup power source is activated and the backup power supply is sent to the controller and the servo motor, in such a manner that the rotor is lifted by a certain distance. As a result, the gap between the external threaded curve surface of the tapered spiral structure of the rotor and the internal threaded curve surface of the tapered spiral structure of the stator is increased, thereby effectively avoiding sand jam. After the power supply is restored, the servo motor controls the controller to lower the rotor to the original position. Even if the sand jam occurs accidentally, it only needs to move up a short distance, and then the gap between the stator and the rotor can be increased to release the jam. At the same time, the rotor and stator are both tapered spiral structures with a larger top and a smaller bottom, so the rotor is also easy to pull out to prevent the jam. d. The sucker rod penetrates the plane bearing and the cross beam from top to bottom. The first clamping member and the reducer are in the sliding fit along the up-down direction, thereby transmitting torque to the sucker rod. The second clamping member abuts against the plane bearing. When moving the rotor up and down (within a lifting stroke of the lifting assembly), there is no need to stop the drive motor, and a working state is maintained to improve efficiency. e. If the liquid level detected by the liquid level detector is lower than a preset range, the controller controls the servo motor to raise the rotor to increase the gap between the stator and the rotor, or controls the drive motor to reduce a rotor speed, or shuts down the drive motor and controls the servo motor to lift the rotor, thereby reducing wear and preventing dry grinding until the liquid level rises to the preset range; and then the controller restores the original working state. f. If gas pressure monitored the pressure sensor monitors is higher than a preset range, the controller shuts down the drive motor, controls the servo motor to lift the rotor, and closes the first valve, so as to make the crude oil in the oil pipeline fall back into the well. Then the controller opens the second valve to inject steam into the well pipe and the oil pipeline, thereby clearing the sleeve, the stator, and the oil pipeline of the screw pump. Specifically, the thick oil is thinned by steam, and the easily solidified substances such as paraffin wax are softened to eliminate blockages. That is to say, the intelligent oil extraction system of the present invention monitors wear, sand content changes, power failure, oil well liquid level drops, oil pipeline blockages, etc., and makes adaptive adjustments, so as to maintain pump efficiency, extend screw pump service life, improve oil extraction efficiency, improve safety, and realize intelligent oil extraction.

DETAILED DESCRIPTION OF THE PREFERRED EMBODIMENT

Figure 1:
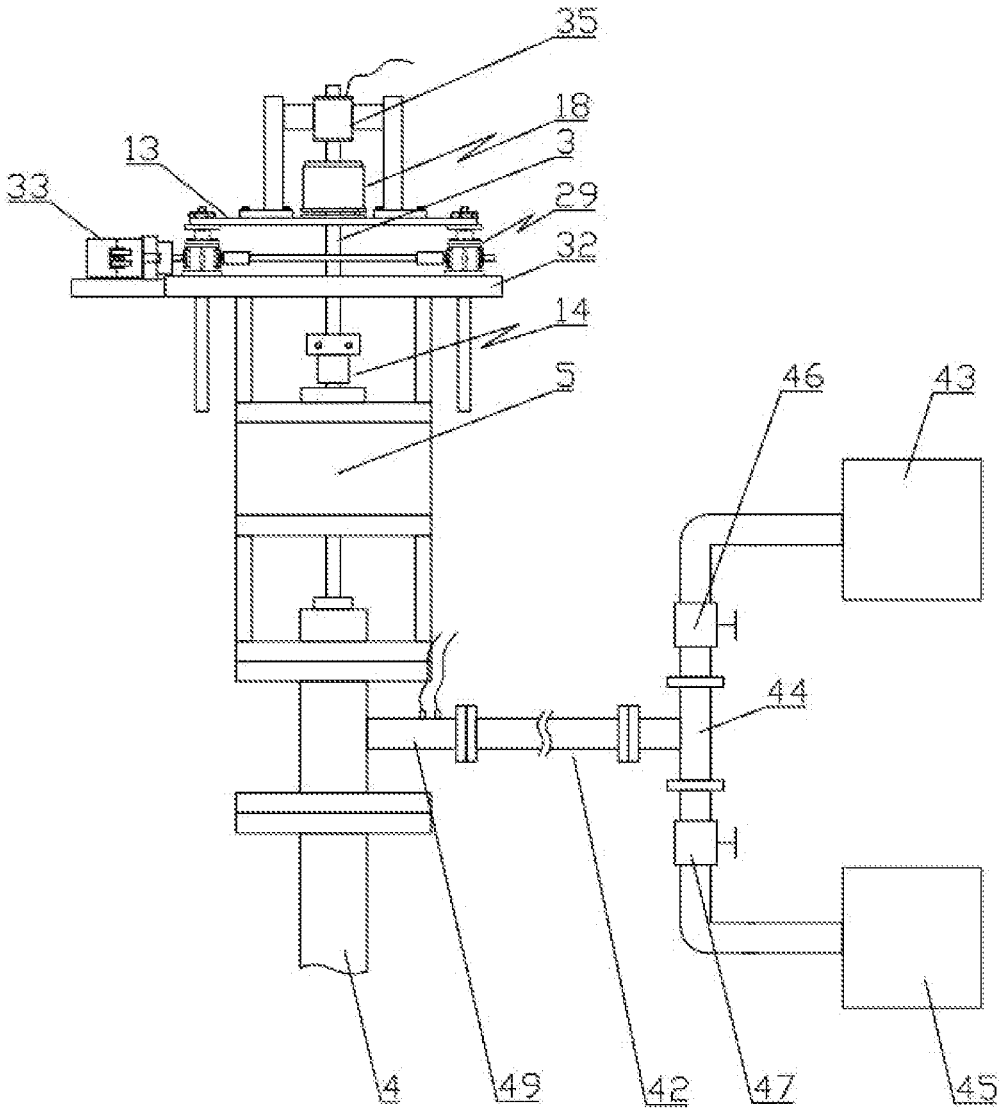
FIG. 1 is a structural view of the present invention, wherein an all-metal screw pump part only shows part of the sleeve.
Figure 2:
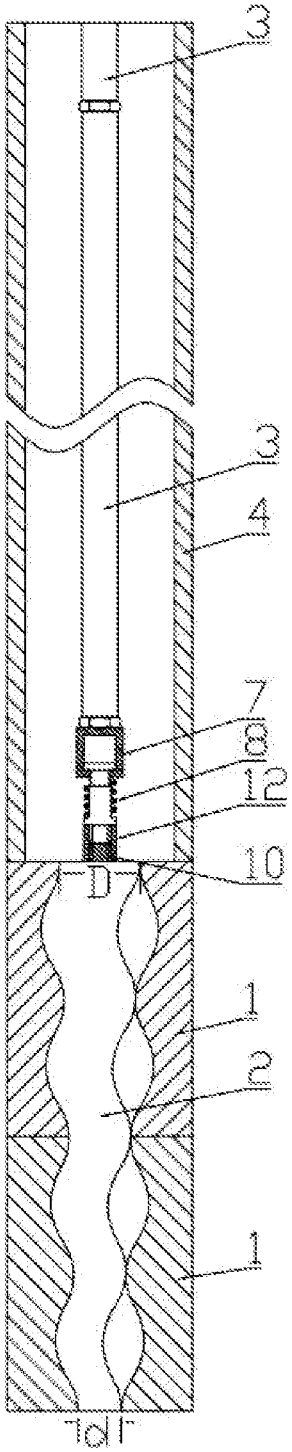
FIG. 2 is a structural view of the all-metal screw pump of the present invention.
Figure 3:
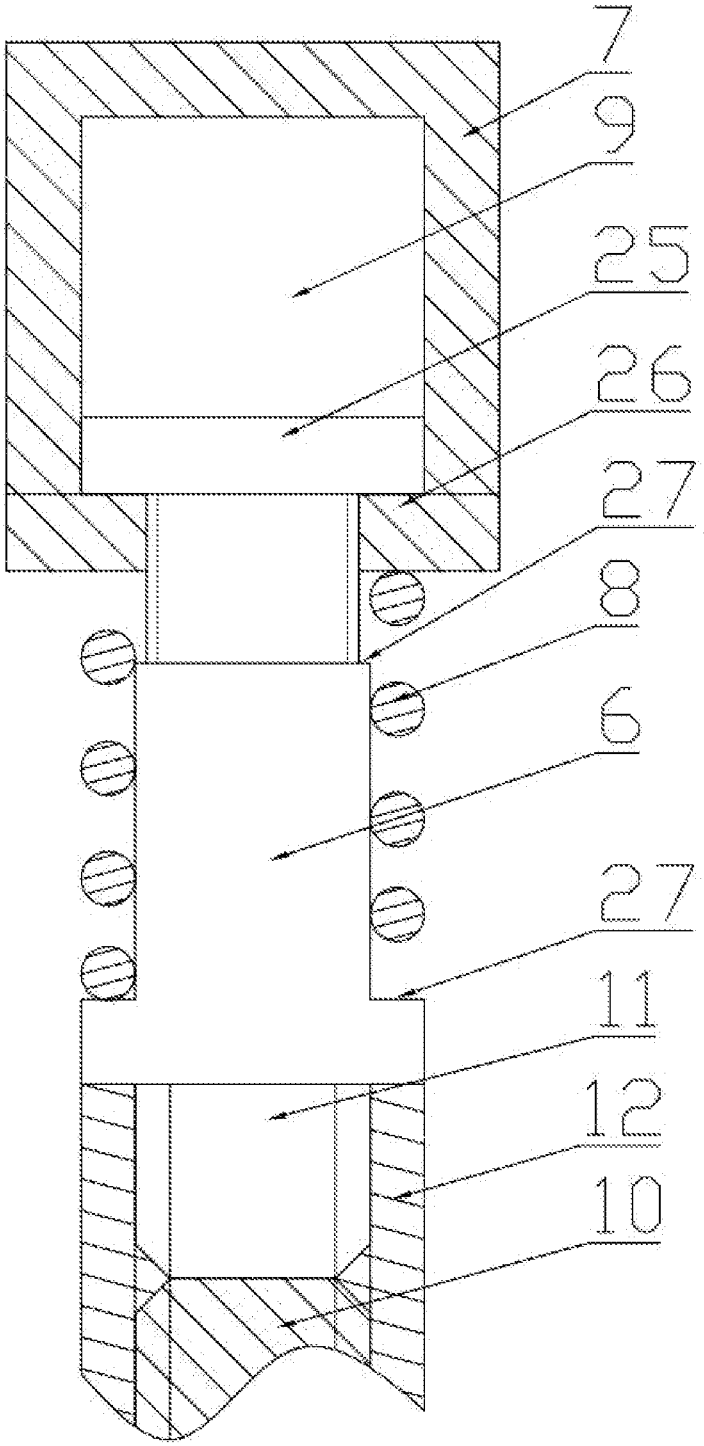
FIG. 3 is a structural view of an elastic telescopic component of the present invention.
Figure 4:
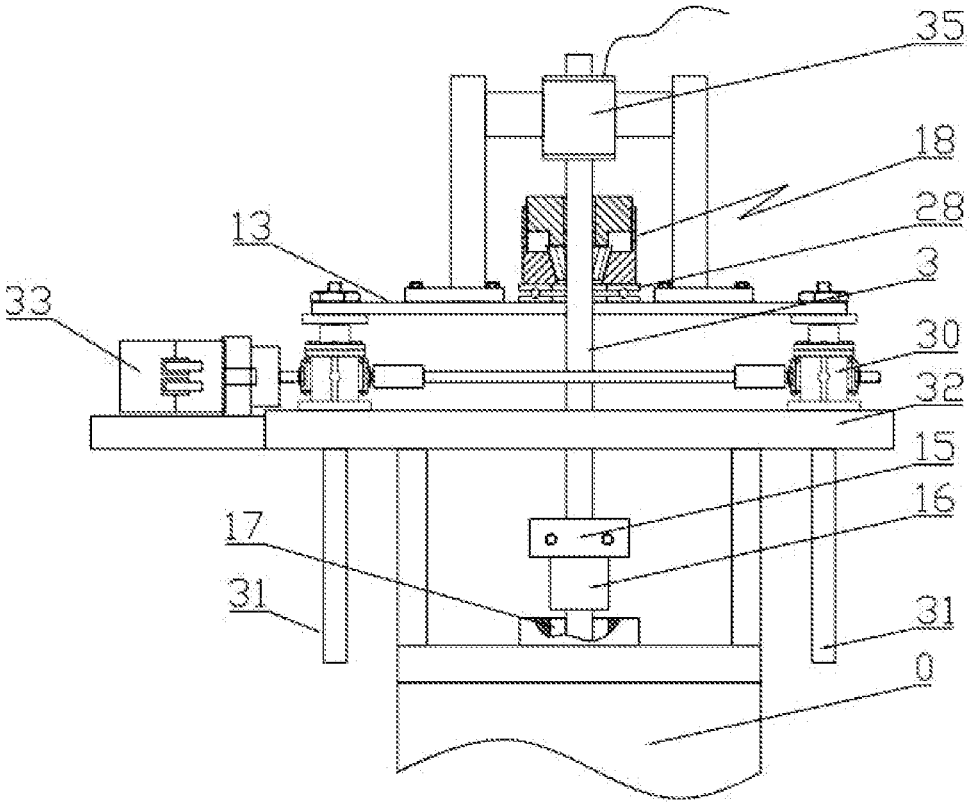
FIG. 4 is a structural view of a lifting mechanism of the present invention.
Figure 5:
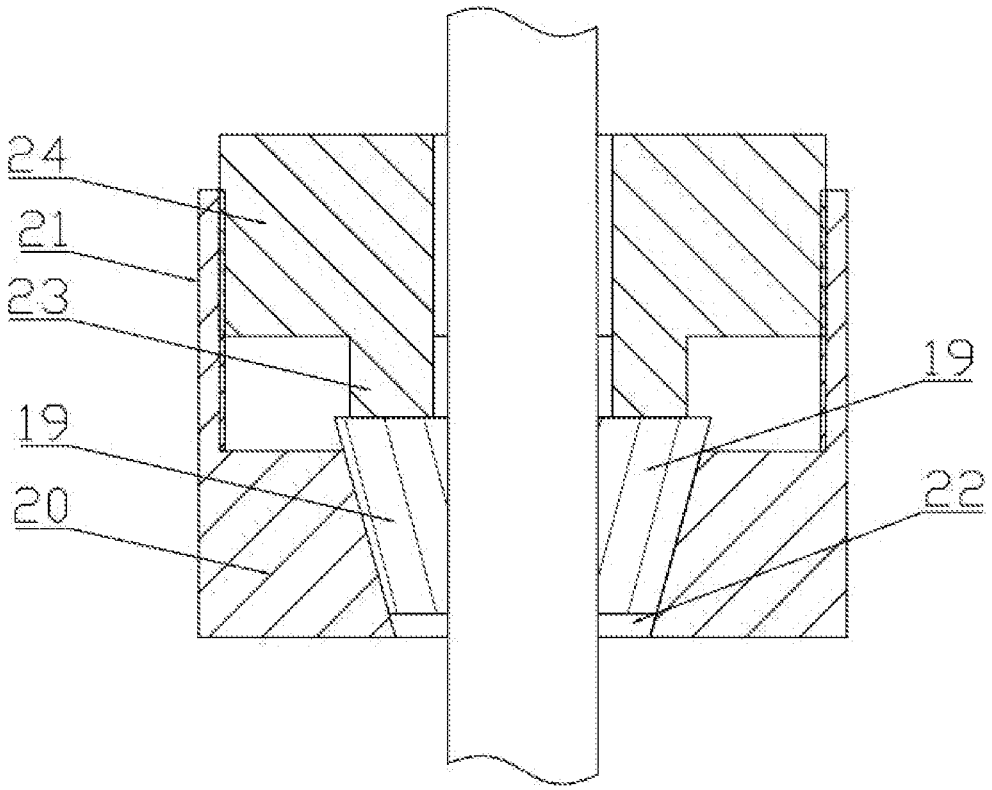
FIG. 5 is a structural view of a second clamping member of the present invention.
Figure 6:
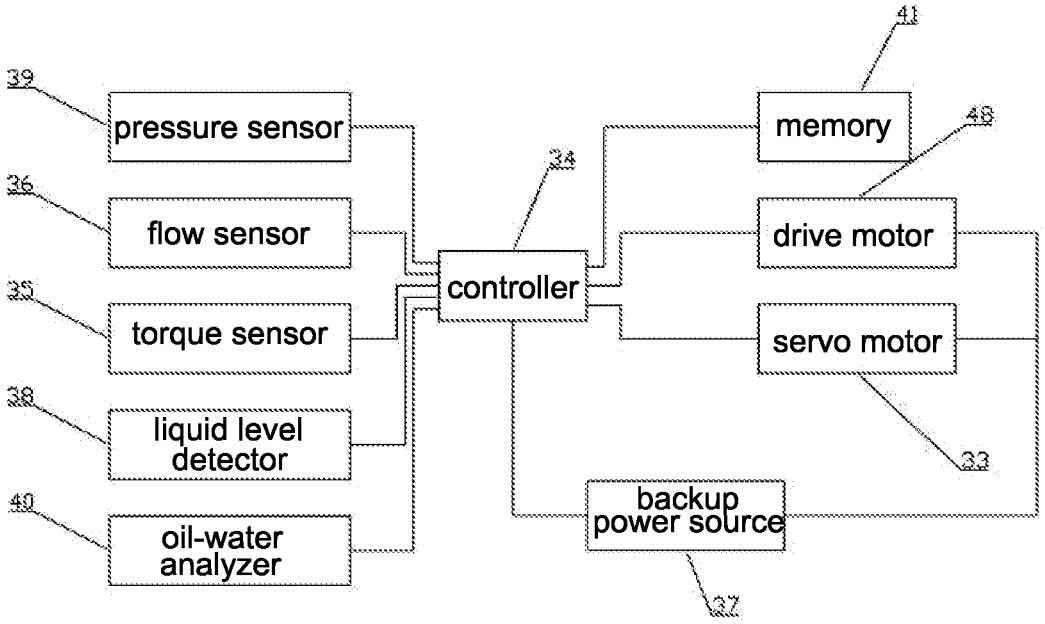
FIG. 6 illustrates a control principle of the present invention.

Referring to FIGS. 1-6, the present invention provides an intelligent oil extraction system using an all-metal screw pump, comprising: the all-metal screw pump, an oil collecting unit 43, and a steam generating unit 45; wherein the all-metal screw pump comprises: a stator 1, a rotor 2, a sucker rod 3, a sleeve 4, a reducer 5, and a drive motor 48; the stator 1 has an internal threaded curve surface; the rotor 2 is installed in the stator 1 and has an external threaded curve surface matched with the internal threaded curve surface of the stator 1; the sleeve 4 is connected to the stator 1, and the sucker rod 3 is installed in the sleeve 4 and connected to the rotor 2; the drive motor 48, the reducer 5 and the sucker rod 3 are connected in sequence; a speed of the drive motor 48 is adjusted by the controller; the internal threaded curve surface and the external threaded curve surface are both tapered spiral structures with equal tapers; a radial dimension D of an upper end of the internal threaded curve surface or the external threaded curve surface is larger than a radial dimension d of a lower end; the oil collecting unit 43 stores crude oil, and the steam generating unit provides steam; an oil outlet 19 of the all-metal screw pump is connected to an input end of an oil pipeline 42, and an output end of the oil pipeline 42 is connected to an oil inlet of the oil collecting unit 43 and a steam outlet of the steam generating unit 45 through a pipe tee 44 and a branch; a first valve 46 is install at the oil inlet of the oil collecting unit 43, and a second valve 47 is installed at the steam outlet of the steam generating unit 45; the oil collecting unit 43 is an oil collecting station, and the steam generating unit 45 is a steam station, which are conventional supporting facilities for oil extraction; the oil extraction system further comprises a lifting mechanism, and the lifting mechanism comprises: a cross beam 13, a first clamping member 14, a second clamping member, a plane bearing, two lifting assemblies, and a servo motor 33; the sucker rod 3 penetrates the plane bearing and the cross beam 13; the first clamping member 14 is detachably fixed to the sucker rod 3 which is below the cross beam 13; the first clamping member 14 and the reducer 5 are in a sliding fit along an up-down direction, thereby transmitting torque to the reducer 5 and the sucker rod 3; the second clamping member is detachably fixed to the sucker rod 3 which is above the cross beam 13; the second clamping member abuts against the plane bearing, and the plane bearing is installed on the cross beam 13; the two lifting assemblies are separately provided at both ends of the cross beam 13, and output ends of the two lifting assemblies are fixed to the cross beam 13; the servo motor 33 drives the lifting assemblies to perform lifting motion; the oil extraction system further comprises a monitoring and control mechanism, and the monitoring and control mechanism comprises: a controller 34, a torque sensor 35, a flow sensor 36, a liquid level detector 38, a pressure sensor 39, an oil-water analyzer 40, a video detector (not shown), a memory 41, and a backup power source 37; the controller 34 is electrically connected to the torque sensor 35, the flow sensor 36, the liquid level detector 38, the pressure sensor 39, the video detector, the backup power source 37, the drive motor 48, the servo motor 33, the first valve, the second valve, the oil-water analyzer 40, and the memory 41; the torque sensor 35 monitors pumping torque of the sucker rod 3; the torque sensor 35 is installed on the cross beam through a frame, and is connected to the sucker rod 3 above the cross beam; the flow sensor 36 monitors a crude oil flow rate in the all-metal screw pump, and is installed at an oil outlet of the all-metal screw pump; the liquid level detector 38 monitors a liquid level in a well, and is installed at a top part of the all-metal screw pump, namely a top of the sleeve; the pressure sensor 39 monitors a gas pressure in the screw pump; the pressure sensor 39 is installed on the reducer and extends into the sleeve; the oil-water analyzer 40 monitors an oil-water ratio of the well in different periods, and a sampling unit of the oil-water analyzer 40 is installed at the oil outlet 49 of the all-metal screw pump; the video detector records the surrounding environment of an installation position of the all-metal screw pump; monitoring data of all the sensors, the oil-water analyzer, the liquid level detector, and the video detector are stored in the memory 41 for later reference; the backup power source 37 supplies power to the controller 34 and the servo motor 33 during power failure.

The first clamping member 14 comprises two first clamping blocks 15; each of the first clamping blocks 15 has an arc-shaped groove matched with the sucker rod 3; the two first clamping blocks 15 are symmetrically assembled and locked by bolts and nuts; bottom ends of the first clamping blocks 15 extend downwards to form a torque transmitting part 16; the torque transmitting part 16 is connected to an output end of the reducer by a key joint, so as to be slidably fitted in the up-down direction; element 17 is a key slot at the output end of the reducer; the second clamping member 18 comprises second clamping blocks 19, a locking sleeve and a locking block; a quantity of the second clamping blocks 19 is no less than two; the locking sleeve comprises a base 20 and a casing 21 connected to a top part of the base 20; a taper hole 22 is drilled at a center of the base 20, which tapers from top to bottom; the base 20 abuts against the plane bearing 28; the locking block comprises a presser 23 and a connecting block 24 connected to a top part of the presser 23; an external contour of the second clamping blocks 19 is matched with the taper hole 22; the second clamping blocks 19 wraps a radial circumference of the sucker rod 3 and are installed in the taper hole 22; the connecting block 24 is threadedly connected to the casing 21; the presser 23 abuts downwards against the second clamping blocks 19.

Each of the lifting assemblies 29 comprises a worm gear box 30 and a screw rod 31; a support frame 32 is installed on a top part of the reducer 5; the worm gear box 30 and the servo motor 33 are installed on the support frame 32; the screw rod 31 vertically penetrates the worm gear box 30 and meshes with a worm gear of the worm gear box 30; a top end of the screw rod is connected to the cross beam 13; worm gear shafts of the worm gear boxes 30 of the lifting assemblies 29 are synchronized by a connecting shaft 6; the servo motor is connected to one of the worm gear shafts, so as to synchronically moving the two lifting assemblies 29.

The intelligent oil extraction system further comprises an elastic telescopic component, wherein the elastic telescopic component comprises a movable part, a fixed part, and an elastic part; the movable part is fixed to the rotor 2, and the fixed part is fixed to the sucker rod 3; the movable part and the fixed part are slidingly fitted in the up-down direction and transmit torque to the sucker rod 3 and the rotor 2; one end of the elastic member abuts against the movable part or the rotor 2, and the other end abuts against the fixed part or the sucker rod 3, so as to elastically contract and expand along a sliding direction of the movable part. The elastic function of the elastic member can also ensure effective contact and sealing between the external threaded curve surface of the rotor and the internal threaded curve surface of the stator, thereby maintaining the pressure and the pump efficiency of a pump body, so as to avoid the sand jams by pumping sand out. The elastic buffer of the elastic member of the elastic telescopic component can avoid rotor damage during assembly processes.

The movable part is a connecting shaft 6, the fixed part is a connecting seat 7, and the elastic part is a spring 8; the connecting shaft 6 is inserted into a cavity 9 of the connecting seat 7, and moves along an axial direction of the connecting seat 7 to transmit torque by cooperating with the connecting seat 7; the spring 8 is sleeved outside the connecting shaft 6; one end of the spring 8 abuts against a limiting plate 26 at a bottom end of the connecting seat 7, and the other end abuts against steps 27 at a bottom end of the connecting shaft 6, so as to elastically contract and expand; an end of the rotor 2 is adjacent to the connecting shaft 6, to which a first threaded joint 10 is connected; an end of the connecting shaft 6 is adjacent to the rotor 2, to which a second threaded joint 11 is connected; the first threaded joint 10 and the second threaded joint 11 are connected by a threaded sleeve 12; the connecting seat 7 is integrally formed or fixedly installed on the sucker rod 3; the elastic telescopic component further comprises a limit component which prevents the connecting shaft 6 from separating from the connecting seat 7; the limit component comprises a first convex flange 25 and the limiting plate 26; the first convex flange 25 is connected to an end of the connecting shaft 6 adjacent to the connecting seat 7, and protrudes outwards in a diameter direction; the limiting plate 26 is connected to an end of the connecting seat 7 adjacent to the connecting shaft 6, and protrudes inwards in a diameter direction; the first convex flange 25 cooperates with the limiting plate 26 to prevent the connecting shaft 6 from separating from the connecting seat 7; external teeth are provided at an end of the connecting shaft 6 adjacent to the first convex flange 25, and internal teeth are provided on the limiting plate 26; the external teeth mesh with the internal teeth, which means the connecting shaft 6 cooperates with the limiting plate 26 through a spline; steps 27, which matches with the limiting plate 26, are provided on the connecting shaft 6, so as to prevent the spring 15 from being over-compressed during assembly, thereby protecting the spring 15 and ensuring efficiency of the spring 15. The connecting seat is integrally formed or fixed on a bottom end of the sucker rod, wherein a thread structure is adopted for fixing, so as to realize detachability.

The controller is a KV-7000 PLC controller (Keyence), the flow sensor is a LWGYC flow sensor (Northess), the torque sensor is a ZJ-A torque speed sensor (Lanling Motor), the liquid level detector is an echo liquid level detector (ECHOMETER, Texas, USA), the oil-water analyzer is a Teledyne 6600 oil-water analyzer, and the first valve and the second valve are electromagnetic valves or electric valves. The above-mentioned controller, flow sensor, torque sensor, pressure sensor, liquid level detector, oil-water analyzer, and memory can also adopt other models commercially available in this field. In other embodiments, the torque sensor is replaced by a current sensor or an additional current sensor is used. The current sensor is used to monitor the current of the pumping drive unit, which feeds back a monitored current signal to the controller. The controller judges the working condition of the pumping drive according to the current, in such a manner that the working condition can be adjusted. When the current is large, the main reason is that friction between the rotor and the stator is large, or the sand jam occurs. Then a signal is fed back to the controller, and is processed immediately to avoid production accidents, thereby improving the safety of the oil well.

What is claimed is:

1. An intelligent oil extraction system using an all-metal screw pump, comprising: the all-metal screw pump, an oil collecting unit, and a steam generating unit; wherein the all-metal screw pump comprises:

a stator, a rotor, a sucker rod, a sleeve, a reducer, and a drive motor;

the stator comprising an internal threaded curved surface;

the rotor installed in the stator and comprising an external threaded curved surface configured to match the internal threaded curved surface of the stator;

the sleeve connected to the stator, and the sucker rod installed in the sleeve and connected to the rotor;

the drive motor directly coupled to the reducer and the reducer directly coupled to the sucker rod, wherein the reducer is coupled between the drive motor and the sucker rod;

the oil collecting unit configured to store crude oil, and the steam generating unit configured to provide steam;

an oil outlet of the all-metal screw pump is-connected to an input end of an oil pipeline, and an output end of the oil pipeline connected to an oil inlet of the oil collecting unit and a steam outlet of the steam generating unit;

a first valve installed at the oil inlet of the oil collecting unit, and a second valve installed at the steam outlet of the steam generating unit;

the internal threaded curved surface and the external threaded curved surface are both tapered spiral structures with equal tapers;

the oil extraction system further comprises a lifting mechanism, and the lifting mechanism comprises:

a cross beam, a first clamping member, a second clamping member, a plane bearing, two lifting assemblies, and a servo motor;

the sucker rod penetrates the plane bearing and the cross beam;

the first clamping member is detachably fixed to a sucker rod part which is below the cross beam;

the first clamping member and the reducer are in a sliding fit along an up-down direction, and configured to transmit torque to the reducer and the sucker rod;

the second clamping member is detachably fixed to a sucker rod part which is above the cross beam;

the second clamping member abuts against the plane bearing, and the plane bearing is installed on the cross beam;

the two lifting assemblies are separately provided at both ends of the cross beam, and output ends of the two lifting assemblies are fixed to the cross beam;

the servo motor configured to drive the lifting assemblies to perform lifting motion;

the oil extraction system further comprises a monitoring and control mechanism, and the monitoring and control mechanism comprises:

a controller, a torque sensor, a flow sensor, a pressure sensor, a liquid level detector, and a backup power source;

the controller is electrically connected to the torque sensor, the flow sensor, the pressure sensor, the liquid level detector, the backup power source, the drive motor, the servo motor, the first valve and the second valve;

the torque sensor configured to monitor pumping torque of the sucker rod;

the flow sensor configured to monitor a crude oil flow rate in the all-metal screw pump;

the pressure sensor configured to monitor a gas pressure in the screw pump;

the liquid level detector configured to monitor a liquid level in a well; and the backup power source configured to supply power to the controller and the servo motor during power failure;

wherein the monitoring and control mechanism further comprises an oil-water analyzer; the oil-water analyzer is electrically connected to the controller, and analyzes an oil-water ratio of the well.

2. The intelligent oil extraction system, as recited in claim 1, wherein the monitoring and control mechanism further comprises a camera; the camera is electrically connected to the controller, and records a surrounding environment of an installation position of the all-metal screw pump.

3. The intelligent oil extraction system, as recited in claim 1, wherein the monitoring and control mechanism further comprises a memory; the memory is electrically connected to the controller.

4. The intelligent oil extraction system, as recited in claim 1, further comprising a current sensor.

5. The intelligent oil extraction system, as recited in claim 1, wherein each of the lifting assemblies comprises a worm gear box and a screw rod; a support frame is installed on a top part of the reducer; the worm gear box and the servo motor are installed on the support frame; the screw rod vertically penetrates the worm gear box and meshes with a worm gear of the worm gear box; a top end of the screw rod is connected to the cross beam; worm gear shafts of the worm gear boxes of the lifting assemblies are synchronized by a connecting shaft; the servo motor is connected to one of the worm gear shafts.

6. The intelligent oil extraction system, as recited in claim 1, wherein the first clamping member comprises two first clamping blocks; each of the first clamping blocks has an arc-shaped groove matched with the sucker rod; bottom ends of the first clamping blocks extend downwards to form a torque transmitting part; the torque transmitting part is connected to an output end of the reducer by a key joint, so as to be slidably fitted in the up-down direction; the second clamping member comprises second clamping blocks, a locking sleeve and a locking block; a quantity of the second clamping blocks is no less than two; the locking sleeve comprises a base and a casing connected to a top part of the base; there is a taper hole at a center of the base, which tapers from top to bottom; the base abuts against the plane bearing; the locking block comprises a presser and a connecting block connected to a top part of the presser; an external contour of the second clamping blocks is matched with the taper hole; the second clamping blocks are configured to wrap a radial circumference of the sucker rod and installed in the taper hole; the connecting block is threadedly connected to the casing; the presser abuts downwards against the second clamping blocks.

7. The intelligent oil extraction system, as recited in claim 1, further comprising an elastic telescopic component, wherein the elastic telescopic component comprises a movable part, a fixed part, and an elastic part; the movable part is fixed to the rotor, and the fixed part is fixed to the sucker rod; the movable part and the fixed part are slidingly fitted in the up-down direction and transmit torque to the sucker rod and the rotor; one end of the elastic member abuts against the movable part or the rotor, and the other end abuts against the fixed part or the sucker rod, so as to elastically contract and expand along a sliding direction of the movable part.

8. The intelligent oil extraction system, as recited in claim 7, wherein the movable part is a connecting shaft, the fixed part is a connecting seat, and the elastic part is a spring; the elastic telescopic component further comprises a limit component; the connecting shaft is configured to be inserted into a cavity of the connecting seat, and to moves along an axial direction of the connecting seat to transmit torque by cooperating with the connecting seat; the spring is sleeved outside the connecting shaft and/or the connecting seat; one end of the spring abuts against the connecting seat or the sucker rod, and the other end abuts against the connecting shaft or the rotor; the limit component prevents the connecting shaft from separating from the connecting seat; an end of the rotor is adjacent to the connecting shaft, to which a first threaded joint is connected; an end of the connecting shaft is adjacent to the rotor, to which a second threaded joint is connected; the first threaded joint and the second threaded joint are connected by a threaded sleeve; the connecting seat is integrally formed or fixedly installed on the sucker rod; the limit component comprises a first convex flange and a limiting plate; the first convex flange is connected to an end of the connecting shaft adjacent to the connecting seat, and protrudes outwards in a diameter direction; the limiting plate is connected to an end of the connecting seat adjacent to the connecting shaft, and protrudes inwards in a diameter direction; external teeth are provided at an end of the connecting shaft adjacent to the first convex flange, and internal teeth are provided on the limiting plate; the external teeth mesh with the internal teeth; steps, which matches with the limiting plate, are provided on the connecting shaft.

* * * * *